US011282689B2

(12) United States Patent
Green et al.

(10) Patent No.: US 11,282,689 B2
(45) Date of Patent: Mar. 22, 2022

(54) CONTROLLING ION TEMPERATURE IN AN ION GUIDE

(71) Applicant: MICROMASS UK LIMITED, Wilmslow (GB)

(72) Inventors: Martin Raymond Green, Bowdon (GB); Kevin Giles, Stockport (GB); David John Langridge, Stockport (GB)

(73) Assignee: MICROMASS UK LIMITED, Wimslow (GB)

( * ) Notice: Subject to any disclaimer, the term of this patent is extended or adjusted under 35 U.S.C. 154(b) by 455 days.

(21) Appl. No.: 16/328,500

(22) PCT Filed: Aug. 25, 2017

(86) PCT No.: PCT/GB2017/052504
§ 371 (c)(1),
(2) Date: Feb. 26, 2019

(87) PCT Pub. No.: WO2018/037240
PCT Pub. Date: Mar. 1, 2018

(65) Prior Publication Data

US 2021/0287893 A1 Sep. 16, 2021

(30) Foreign Application Priority Data

Aug. 26, 2016 (GB) ..... 1614540

(51) Int. Cl.
*H01J 49/06* (2006.01)
*H01J 49/00* (2006.01)

(52) U.S. Cl.
CPC ..... *H01J 49/065* (2013.01); *H01J 49/005* (2013.01); *H01J 49/068* (2013.01)

(58) Field of Classification Search
CPC ..... H01J 49/0045; H01J 49/005; H01J 49/06; H01J 49/062; H01J 49/063; H01J 49/065; H01J 49/068
See application file for complete search history.

(56) References Cited

U.S. PATENT DOCUMENTS 7,514,677 B2 4/2009 Choi et al.
9,324,548 B1 * 4/2016 Benter ..... H01J 49/065
(Continued)

FOREIGN PATENT DOCUMENTS

CN 101305444 A 11/2008
CN 105719936 A 6/2016
(Continued)

OTHER PUBLICATIONS

Webb et al. "Trapping-Mode Dipolar DC Collisional Activation in the RF-Only Ion Guide of a Linear Ion Trap/Time-of-Flight Instrument for Gaseous Bio-Ion Declustering", J. Mass. Spectrom, 2013, 48, 1059-1065 (Year: 2013).*
(Continued)

*Primary Examiner* — David E Smith
(74) *Attorney, Agent, or Firm* — Kacvinsky Daisak Bluni PLLC

(57) ABSTRACT

There is provided a method of guiding ions, comprising providing an ion guide comprising a plurality of electrodes, confining ions radially within said ion guide by applying one or more voltages to said plurality of electrodes, applying an orthogonal DC field along at least a portion of said ion guide in order to control the temperature of ions as they travel through said ion guide, and applying an electrostatic driving potential to said plurality of electrodes to urge ions along the axial length of the ion guide, wherein said electrostatic driving potential is applied in the form of a DC travelling wave potential or other transient DC potential.

14 Claims, 4 Drawing Sheets

(56) References Cited

U.S. PATENT DOCUMENTS

| | | | | |
|---|---|---|---|---|
| 2004/0026612 | A1* | 2/2004 | Bateman | H01J 49/062 250/281 |
| 2011/0127417 | A1* | 6/2011 | Ibrahim | H01J 49/004 250/282 |
| 2014/0145095 | A1* | 5/2014 | McLuckey | H01J 49/063 250/489 |

FOREIGN PATENT DOCUMENTS

| | | | |
|---|---|---|---|
| WO | 2004023516 | A1 | 3/2004 |
| WO | 2012174198 | A2 | 12/2012 |
| WO | 2015092399 | A1 | 6/2015 |

OTHER PUBLICATIONS

International Search Report and Written Opinion for International Application No. PCT/GB2017/052504 dated Oct. 30, 2017, 16 pages.

Combined Search and Examination Report under Sections 17 and 18(3) for GB Application No. GB1713673.0 dated Jan. 31, 2018, 7 pages.

Search Report for GB Application No. GB1614540.1, dated Jan. 11, 2017, 4 pages.

Webb et al., "Implementation of dipolar direct current (DDC) collision-induced dissociation in storage and transmission modes on a quadrupole/time-of-flight tandem mass spectrometer", Rapid Communications in Mass Spectrometry, 25(17): 2500-2510, Aug. 4, 2011.

Webb et al., "Trapping mode dipolar DC collisional activation in the RF-only ion guide of a linear ion trap/time-of-flight instrument for gaseous bio-ion declustering : DDC CA for ion declustering", Journal of Mass Spectrometry, 48 (9); 1059-1065, Aug. 30, 2013.

* cited by examiner

CONTROLLING ION TEMPERATURE IN AN ION GUIDE

CROSS-REFERENCE TO RELATED APPLICATIONS

This application is a national phase filing claiming the benefit of and priority to International Patent Application No. PCT/GB2017/052504, filed on Aug. 25, 2017, which claims priority from and the benefit of United Kingdom patent application No. 1614540.1 filed on Aug. 26, 2016. The entire contents of these applications are incorporated herein by reference.

FIELD OF THE INVENTION

The present invention relates generally to mass spectrometry and methods of mass spectrometry, and more specifically to ion guides and methods of guiding ions.

BACKGROUND

The formation of non-covalently bound solvent and salt complexes can cause problems with characterization of large bimolecular ions in atmospheric ionization ion sources. Increasing the temperature of these ions can selectively remove these weakly bound adducts and provide higher quality mass spectral data. Background solvent clusters can also affect detection limits in small molecule analysis.

Methods such as RF boundary activation in multipole ion traps and collisional activation have been described. Reference is made to "Trapping mode dipolar DC collisional activation in the RF-only ion guide of a linear ion trap/time-of-flight instrument for gaseous bio-ion declustering" (Journal of Mass Spectrometry, Volume 48, Issue 9, pages 1059-1065, 2013). In addition, de-solvation or de-clustering has been observed in RF only ion funnels due to RF heating. Reference is made to "The ion funnel: Theory, implementations, and applications" (Mass Spectrometry Reviews, Volume 29, Issue 2, pages 294-312, 2010).

US 2011/0127417 (Ibrahim) discloses a system and method for collisional activation of charged particles.

WO 2012/174198 (Bennett) discloses methods and apparatus for dipolar DC collisional activation of ions transmitted through an electrodynamic multipole device.

Webb et al. discloses methods and apparatus in "Implementation of dipolar direct current (DDC) collision-induced dissociation in storage and transmission modes on a quadrupole/time-of-flight tandem mass spectrometer" (Rapid Communications in Mass Spectrometry, Volume 25, Issue 17, 15 Sep. 2011, pp. 2500-2510).

U.S. Pat. No. 9,324,548 (Benter) discloses methods and devices to increase the internal energy of ions in mass spectrometers.

WO 2004/023516 (Micromass) discloses a mass spectrometer.

It is desired to improve how the temperature of ions is controlled as they travel through an ion guide.

SUMMARY

According to an aspect of the present invention, there is provided a method of guiding ions, comprising:

providing an ion guide comprising a plurality of electrodes;

confining ions radially within the ion guide by applying one or more voltages to the plurality of electrodes; and applying an orthogonal DC field along at least a portion of the ion guide in order to control (e.g., increase or decrease) the temperature of ions as they travel through said ion guide.

The method may further comprise applying an electrostatic driving potential to said plurality of electrodes to urge ions along the axial length of the ion guide.

In various embodiments the ion guide, for example a stacked ring ion guide or segmented multipole ion guide, may provide controlled heating of ions as they transit the ion guide through the use of the orthogonal DC field.

The electrostatic driving potential may control the transit time or amount of heating experienced by ions (e.g., different groups of ions) as they travel through the ion guide. For example, the electrostatic driving potential may be varied (e.g., increased or decreased) to vary (e.g., decrease or increase) the transit time or amount of heating experienced by ions (e.g., different groups of ions) as they travel through the ion guide.

The electrostatic driving potential may be in the form of a transient DC potential applied to the electrodes, such as a travelling wave, or a static DC driving potential. The magnitude or speed of the electrostatic driving potential may be used to control (e.g., increase or decrease) the transit, drift or residence time of ions within the ion guide and hence duration of heating.

US 2011/0127417 (Ibrahim) does not disclose or suggest use of an electrostatic driving potential to control (e.g., adjust) the transit time or amount of heating experienced by different groups of ions as they travel through the ion guide.

The duration of heating of different groups of ions may be adjusted by modifying the electrostatic driving potential experienced by different groups of ions as they travel through the ion guide.

The step of confining ions radially within the ion guide may comprise applying one or more AC or RF voltages to the plurality of electrodes, so that they optionally form AC or RF electrodes.

The temperature of the ions as they travel through the ion guide may be increased by increasing the amplitude or strength of the orthogonal DC field. The temperature of the ions as they travel through the ion guide may be decreased by decreasing the amplitude or strength of the orthogonal DC field.

The electrostatic driving potential may be applied in the form of a DC travelling wave potential or other transient DC potential. Alternatively, the electrostatic driving potential may be applied in the form of a static DC voltage, for example wherein a static DC voltage is applied to the electrodes that progressively decreases along the length of the ion guide (e.g., from an upstream end to a downstream end).

The amplitude or strength of the orthogonal DC field may be less than, greater than or substantially equal to about 5 V, 10 V, 15 V, 20 V, 25 V or 30 V.

Additionally, or alternatively, the voltage or amplitude of the electrostatic driving potential may be less than, greater than or substantially equal to about 5 V, 10 V, 15 V, 20 V, 25 V or 30 V.

As used herein, "orthogonal" may be interpreted to mean orthogonal to the direction of travel or flow of ions, for example the instantaneous direction of travel of ions. The orthogonal DC field may urge ions in a single orthogonal direction. This may be distinct from a radial force, for example, which typically urges ions radially outwards in all radial directions.

The orthogonal DC field may be applied (and/or the plurality of electrodes may be arranged and configured) such that ions travelling through the ion guide are urged in a direction orthogonal to their direction of travel, for example towards the electrodes (e.g., the AC or RF electrodes) that act to radially confine the ions within the ion guide.

The orthogonal DC field may be applied (and/or the plurality of electrodes may be arranged and configured) such that the average path taken by ions through the ion guide is displaced in a radial (or orthogonal) direction, for example towards the electrodes (e.g., the AC or RF electrodes) that act to radially confine the ions within the ion guide.

The method may further comprise transmitting ions through the ion guide (e.g., continuously), and selectively applying the orthogonal DC field in order to control (e.g., increase or decrease) the temperature of selected ions as they travel through the ion guide. Ions may be selected based on one or more physico-chemical properties, for example retention time, mass, mass to charge ratio or ion mobility.

The method may further comprise transmitting ions through the ion guide (e.g., continuously), and varying the amplitude or strength of the orthogonal DC field applied to different ions as they travel through the ion guide, for example throughout the course of an experimental run, such as a single chromatography separation.

The method may further comprise applying an electrostatic driving potential to the plurality of electrodes to urge ions along the axial length of the ion guide, and:

(i) varying the amplitude or strength of the orthogonal DC field to achieve a desired temperature for selected ions as they travel through the ion guide; and (ii) varying the properties of the electrostatic driving potential to achieve a desired transit time for selected ions through the ion guide.

The selected ions may have a specified value or range of one or more physico-chemical properties, for example retention time(s), mass(es), mass to charge ratio(s) or ion mobility (ies).

The method may further comprise transmitting a plurality of groups of ions through the ion guide, and selectively applying the orthogonal DC field in order to control (e.g., increase or decrease) the temperature of selected groups of ions as they travel through the ion guide.

For example, the orthogonal DC field may be applied as a first group of ions travels through the ion guide, and may not be applied as a second, different group of ions travels through the ion guide.

The method may comprise selecting groups of ions for heating through the application of the orthogonal DC field.

The method may further comprise transmitting a plurality of groups of ions through the ion guide, and varying the amplitude or strength of the orthogonal DC field applied to different groups of ions as they travel through the ion guide.

For example, the amplitude or strength of the orthogonal DC field may be set relatively high as a first group of ions travels through the ion guide, and may be set relatively low as a second, different group of ions travels through the ion guide.

The method may comprise selecting groups of ions for application of an orthogonal DC field having a relatively high amplitude or strength (e.g., above about 5 V or 10 V), and/or selecting groups of ions for application of an orthogonal DC field having a relatively low amplitude or strength (e.g., below about 5 V or 10 V respectively).

The method may further comprise applying an electrostatic driving potential to the plurality of electrodes to urge a group of ions along the axial length of the ion guide, and:

(i) varying the amplitude or strength of the orthogonal DC field to achieve a desired temperature of ions within the group of ions as they travel through the ion guide; and (ii) varying the properties of the electrostatic driving potential to achieve a desired transit time of ions within the group of ions through the ion guide.

The properties of the electrostatic driving potential that may be varied may include amplitude and/or, in the case of a travelling wave DC potential, velocity of the travelling wave.

The ion guide may comprise a first ion guiding region, a second ion guiding region downstream of the first ion guiding region, and a third ion guiding region downstream of the second ion guiding region, and the method may further comprise:

applying the orthogonal DC field in the second ion guiding region so as to deflect ions travelling through the second ion guiding region in an orthogonal direction. There may be no orthogonal DC field applied in the first and third ion guiding regions, noting that this may not exclude application of a radial (or axial) DC field.

The second ion guiding region may comprise a plurality of electrodes, each having an aperture through which ions travel in use. Alternatively, the second ion guiding region may comprise a segmented multipole (e.g., quadrupole) ion guide.

The method may further comprise applying an axial DC field along the length of the ion guide, wherein the strength of the axial DC field increases between the first ion guiding region and the second ion guiding region, and/or between the second ion guiding region and the third ion guiding region.

The method may further comprise transmitting a plurality of groups of ions through the ion guide, each group having a different range of one or more physico-chemical properties (e.g., one or more of mass, mass to charge ratio, ion mobility) and/or may have been separated by a chromatograph. The method may comprise selectively applying the orthogonal DC field in order to control (e.g., increase or decrease) the temperature of selected groups of ions as they travel through the ion guide. The selected groups of ions may each have a different range of one or more physico-chemical properties (e.g., one or more of mass, mass to charge ratio, and ion mobility). The orthogonal DC field may not be applied, or may be switched off for other (e.g., non-selected) groups of ions travelling through the ions guide, for example during the same experimental run, such as during separation of the same chromatography column. The duration of heating for each group of ions may be adjusted or varied, for example by modifying the electrostatic driving potential experienced by different groups of ions as they travel through the ion guide as discussed above. For example, the magnitude or speed/velocity of the electrostatic driving potential may be adjusted or varied, so as to control (e.g., increase or decrease) the transit, drift or residence time of ions within the ion guide and hence duration of heating.

The method may comprise determining the ion mobility range of a first group of ions, selecting the first group of ions for heating within the ion guide, and applying the orthogonal DC field in order to control (e.g., increase or decrease) the temperature of the first group of ions as the first group of ions travel through the ion guide. The orthogonal DC field may not be applied, or may be switched off for other (e.g., non-selected) groups of ions travelling through the ions guide, for example during the same experimental run, such as during separation of the same chromatography column.

The method may further comprise transmitting a plurality of groups of ions through the ion guide, each having a different range of mass to charge ratios, and selectively applying the orthogonal DC field in order to control (e.g., increase or decrease) the temperature of selected groups of ions as they travel through the ion guide. The orthogonal DC field may not be applied, or may be switched off for other (e.g., non-selected) groups of ions travelling through the ions guide, for example during the same experimental run, such as during separation of the same chromatography column.

The method may comprise determining the mass to charge ratio range of a first group of ions, selecting the first group of ions for heating within the ion guide, and applying the orthogonal DC field in order to control (e.g., increase or decrease) the temperature of the first group of ions as the first group of ions travel through the ion guide.

The method may comprise determining the mass to charge ratio range of a second group of ions, not selecting the second group of ions for heating within the ion guide, and not applying or switching off the orthogonal DC field as the second group of ions travel through the ion guide.

The first and second groups of ions may be created during the same experimental run, such as during separation of the same chromatography column.

The method may comprise providing a mass filter or analytical ion trap or mass selective ion trap upstream of the ion guide, wherein the mass filter or analytical ion trap or mass selective ion trap may be arranged and configured to filter or select ions according to their mass to charge ratio, and may be further arranged and configured to pulse ions into the ion guide in groups, wherein each group of ions has a different range of mass to charge ratios.

Alternatively, or additionally the method may comprise providing an ion mobility spectrometer or separator upstream of the ion guide, wherein the ion mobility spectrometer or separator may be arranged and configured to filter or select ions according to their ion mobility, and may be further arranged and configured to pulse ions into the ion guide in groups, wherein each group of ions has a different range of ion mobilities.

The method may comprise providing one or more separation devices upstream of the ion guide, wherein the one or more separation devices may be arranged and configured to separate ions according to one or more physico-chemical properties, and may be further arranged and configured to pulse ions into the ion guide in groups, wherein each group of ions has a different range of the one or more physico-chemical properties.

The one or more physico-chemical properties may include one or more of mass, mass to charge ratio, ion mobility and differential ion mobility.

The ion guide may be an "ion tunnel ion guide", that is comprising a plurality of electrodes, each having an aperture through which ions travel in use. In other words, the ion guide may be a stacked ring ion guide. The electrodes forming the ion guide may be segmented in a direction orthogonal to the direction of travel of ions, such that each electrode comprises an upper segment and a lower segment. The upper segment may be connected to a positive terminal of a DC voltage supply, and the lower segment may be connected to a negative terminal of the DC voltage supply, so as to form the orthogonal DC field. Other methods of forming the orthogonal DC field in such embodiments are envisaged, for example using auxiliary electrodes as discussed below. It has been found that, for a given amplitude of orthogonal DC potential, the heating experienced by ions within an ion tunnel ion guide is increased when compared to other types of ion guide (e.g., with similar internal cross section and magnitude of confining RF). In other words, for the same amount of heating you can experience the same transit time for ions through the ion guide, but with a lower orthogonal DC potential. Furthermore, the mass to charge ratio transmission of an ion tunnel ion guide is typically broader than other types of ion guide, and also entrance conditions for ion tunnel ion guides are typically better.

The ion guide may comprise a segmented multipole ion guide, for example a segmented quadrupole, hexapole or octopole ion guide.

An upper pair of rod electrodes, e.g., including all of the segments along the upper pair of rod electrodes, may be connected to a positive terminal of a DC voltage supply, and a lower pair of rod electrodes, e.g., including all of the segments along the lower pair of rod electrodes may be connected to a negative terminal of the DC voltage supply, so as to form the orthogonal DC field. Other methods of forming the DC field in such embodiments are envisaged, for example the orthogonal DC field may alternatively be applied as a dipole across a pair of opposing rods.

The method may further comprise supplying a buffer gas to the ion guide.

The ion guide may form part of a collision, fragmentation or reaction cell.

The method may comprise switching between a first mode of operation, in which ions (e.g., the ions that are not selected for heating) are not subject to heating via the orthogonal DC field (e.g., the orthogonal DC field is not applied or set at a relatively low amplitude or field strength) and a second mode of operation, in which ions (e.g., the ions that are selected for heating) are subject to heating via the orthogonal DC field (e.g., the orthogonal DC field is applied and/or set at a relatively high amplitude or field strength).

The method may further comprise applying the orthogonal DC field using one or more auxiliary electrodes. For example, the only voltage or potentials applied to the one or more auxiliary electrodes may be the orthogonal DC field.

Controlling the temperature of ions as they travel through the ion guide may comprise applying the orthogonal DC field at a strength and/or for a time sufficient for ions (e.g., the ions selected for heating) to reach a set, given or predetermined temperature. The set, given or predetermined temperature may be a temperature sufficient to remove adduct molecules from the selected ions in use.

In other words, the method may be a method of heating ions to selectively remove adduct molecules from ions, for example weakly and/or covalently bound adducts from ions, for example as they travel through the ion guide.

All of the methods described herein may be carried out as part of a single experimental run, for example a single cycle of separation. One example is a single chromatography run, such as separation of a single chromatography column. In this example adducts can attach to ions (e.g., peptide or protein ions) in such chromatography separations and it can be difficult to remove these adducts prior to detecting ions in a mass spectrometer. The methods disclosed herein solve this problem, but also many other problems where it may be beneficial to control the heating of ions as they travel through an ion guide.

According to an aspect of the present invention, there is provided a method of mass spectrometry comprising a method as described above.

According to an aspect of the present invention, there is provided an apparatus comprising:

an ion guide comprising a plurality of electrodes, and a control system, wherein the control system is arranged and adapted to:

apply one or more voltages to said plurality of electrodes to confine ions radially within said ion guide in use;

apply an orthogonal DC field along at least a portion of said ion guide in order to control the temperature of ions as they travel through said ion guide in use; and apply an electrostatic driving potential to said plurality of electrodes to urge ions along the axial length of the ion guide, wherein said electrostatic driving potential is applied in the form of a DC travelling wave potential or other transient DC potential.

According to an aspect of the present invention, there is provided an apparatus comprising:

an ion guide comprising a plurality of electrodes;

a first voltage supply arranged and configured to apply one or more voltages to the plurality of electrodes to confine ions radially within the ion guide in use; and a second voltage supply arranged and configured to apply an orthogonal DC field along at least a portion of the ion guide in order to control (e.g., increase or decrease) the temperature of ions as they travel through the ion guide in use.

According to an aspect of the present invention, there is provided a spectrometer, for example a mass spectrometer comprising an apparatus as described above.

The spectrometer may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The spectrometer may comprise one or more continuous or pulsed ion sources.

The spectrometer may comprise one or more ion guides, including the ion guide described above but also other ion guides as appropriate.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer or ion guide (as described above and in accordance with the disclosure) may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser. The mass analyser may be located upstream of the ion guide.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter. The mass filter may be located upstream of the ion guide.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer or ion guide (as described above and in accordance with the disclosure) may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer or ion guide (as described above and in accordance with the disclosure) may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide of the spectrometer, or the ion guide as described above and in accordance with the disclosure, may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide (e.g., as described above and in accordance with the disclosure) or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

A chromatography detector may be provided, wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

A control system may be provided to carry out any or all of the method steps described above in relation to the method according to any of the aspects or embodiments of the disclosure.

BRIEF DESCRIPTION OF THE DRAWINGS

Various embodiments will now be described, by way of example only, and with reference to the accompanying drawings in which.

DETAILED DESCRIPTION

Figure 1:
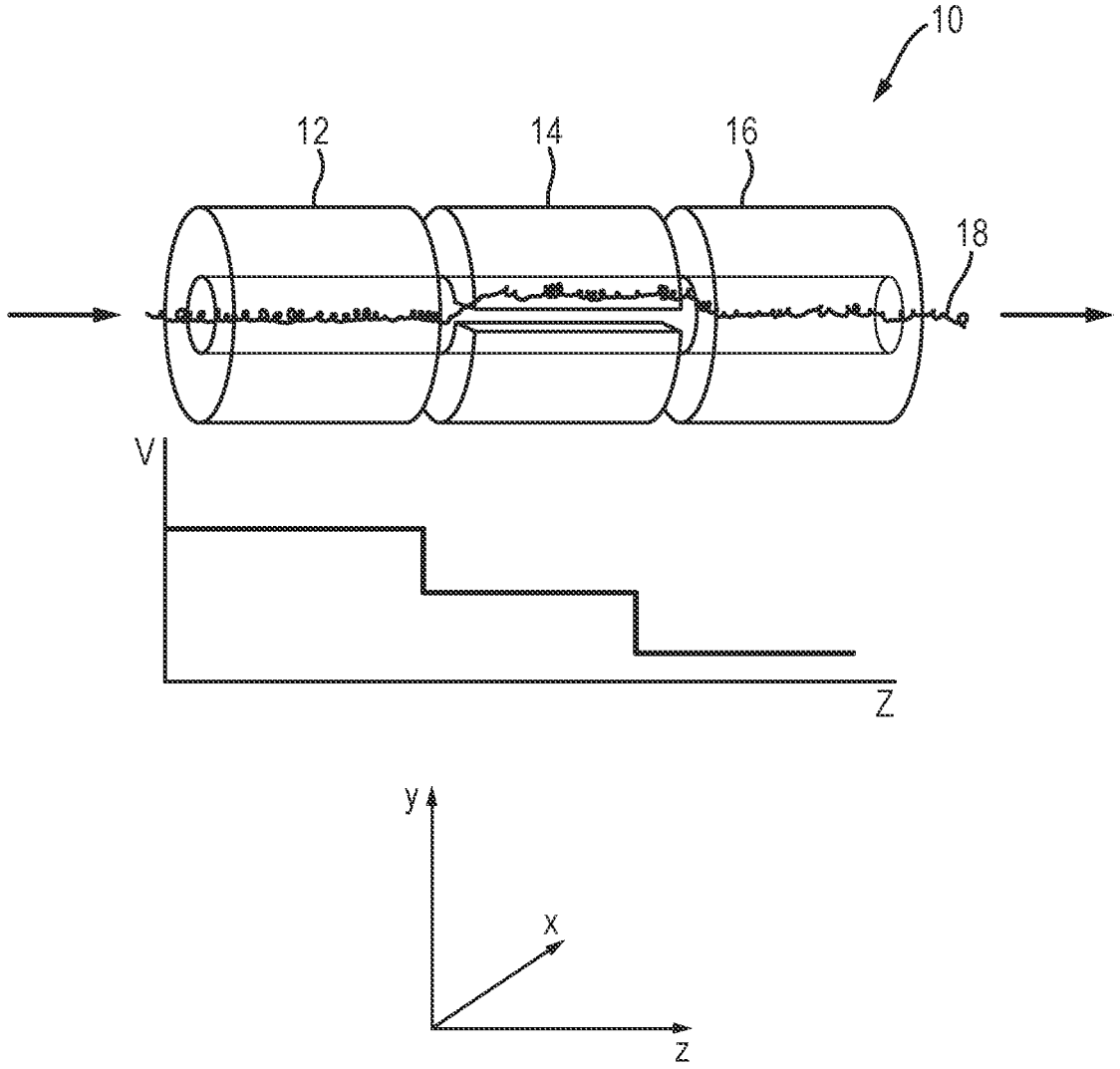
FIG. 1 shows a non-limiting embodiment of the present disclosure involving an ion guide that is split into three sections.

The present disclosure relates generally to a method of guiding ions, wherein an ion guide is provided that comprises a plurality of electrodes. Ions are confined radially within the ion guide by applying one or more voltages to the plurality of electrodes, and an orthogonal DC field is applied along at least a portion of the ion guide in order to control (e.g., increase or decrease) the temperature of ions as they travel through the ion guide. An electrostatic driving potential may be applied to the plurality of electrodes to urge ions along the axial length of the ion guide In various embodiments the ion guide, for example a stacked ring ion guide or segmented multipole ion guide, may provide controlled heating of ions as they transit the ion guide through the use of the orthogonal DC field. The electrostatic driving potential may be in the form of a transient DC potential applied to the electrodes, such as a travelling wave, or a static DC driving potential.

The magnitude or speed (or other parameter) of the electrostatic driving potential may be used to control (e.g., increase or decrease) the transit, drift or residence time of ions within the ion guide and hence duration of heating.

The electrostatic driving potential may be applied to the plurality of electrodes to urge ions along the axial length of the ion guide, and: (i) vary the amplitude of the orthogonal DC field to achieve a desired temperature of the ions as they travel through the ion guide; and (ii) vary the properties of the electrostatic driving potential to achieve a desired transit time of the ions through the ion guide. The properties of the electrostatic driving potential that may be varied may include amplitude and/or, in the case of a travelling wave DC potential, velocity of the travelling wave.

The ion guide may be provided as part of a collision or reaction cell (or it may be a collision or reaction cell), in which, e.g., the amount of dissociation may be adjusted by a combination of adjusting one or more of the radial RF voltage applied to the electrodes, adjusting the temperature of the ions (by adjusting the orthogonal DC potential), and adjusting the time over which ions experience this elevated temperature (by adjusting the electrostatic driving potential). These two parameters (temperature and duration of heating) may be optimised for different groups of ions, as discussed above, for example groups of ions at different retention times and mass to charge ratios.

Ions may be continuously introduced into the ion guide, for example as part of a liquid chromatography ("LC") run, in which ions having a particular retention time may be selected for heating. Alternatively, the ions could be pulsed into the ion guide in groups, wherein the ions in each group may have a specific range of mass to charge ratios such that different heating can be applied to ions in different groups.

In various embodiments ions having a particular retention time may be targeted for heating. The targeted ions may comprise those having weakly and/or covalently bound adducts. The methods described herein can be particularly useful for high molecular weight bio-molecules, such as proteins and protein complexes.

FIG. 1 shows an embodiment of the invention in which an apparatus comprises an ion guide 10 that may be split into three ion guiding regions 12, 14 and 16.

In all of the ion guiding regions 12, 14 and 16 ions may be contained radially by the application of an AC or RF voltage or potential. This forms a pseudo-potential that radially confines ions within the ion guiding regions 12, 14 and 16. Ions may also be contained radially by using a combination of an AC or RF voltage or potential and DC confinement.

Ions may be urged from an entrance end to an exit end of each of the sections by application of an electrostatic driving potential, for example a travelling wave potential or other transient DC potential, by a static DC potential (e.g., a voltage ramp) or a combination of these potentials.

Referring to FIG. 1, a first region 12 of the ion guide 10 may consist of a series of stacked ring electrodes, wherein an AC or RF voltage may be applied to the electrodes in order to confine ions radially within the first section 12. A third region 16 of the ion guide 10 may also comprise a series of stacked ring electrodes, and may be configured and operated in the same manner as the first region 1.

A central and second region 14 of the ion guide 10 may also comprise a series of stacked ring electrodes but may additionally be configured and operated in such a manner that a DC field may be applied orthogonally to the direction of travel of ions through the ion guide 10. An AC or RF voltage may be applied to the electrodes in order to confine ions radially within the first region 12. The first region 12 may be upstream of the second region 14, and the third region 16 may be downstream of the second region 14.

Application of the orthogonal DC field can have the effect of urging ions travelling through the second region 14 towards the electrodes, such that the average path taken by ions travelling through the second region 14 is closer to the electrodes than it would be without the application of the DC field. For example, the average path taken by ions travelling through the second region 14 may be closer to the electrodes than the average path taken by ions travelling through the first region 12 and the third region 16 (which may be typically closer to the central axis of the ion guide 10).

It is within this second region 14 that the temperature of the ions traversing the ion guide may be controlled, in accordance with the disclosure.

The ion guiding regions 12, 14 and 16 may contain a buffer gas to allow collisional cooling and collisional activation of ions, and may be maintained at a pressure of $10^{-4}$ mbar through to 5 mbar.

FIG. 1 shows the path 18 of the ions traversing the ion guiding regions 12, 14 and 16. As will be appreciated, ions travel through first region 12 and then pass through the second region 14, at which point they are deflected off axis by the orthogonal DC field so that they travel closer to the electrodes of the second ion guiding region 14. Once they leave the second region 14 they pass into the third region 16, and move back to the central or longitudinal axis of the ion guide 10 since the orthogonal DC field may not be applied in the third region 16.

The broadest aspects of this disclosure relate to the use of the orthogonal DC field to control the temperature of ions as they traverse the ion guide 10. As well as these advantages, the particular arrangement of ion guiding regions shown in FIG. 1 can also allow highly efficient transmission of ions. For example, ions can settle in the first ion guiding region 12 before being transported into the second ion guiding region 14, leading to a reduction in ion losses. Ions exiting the second ion guiding region 14 may relax (such that the average path taken by ions returns to the central axis of the ion guide 20) upon entering the third ion guiding region 16, allowing efficient extraction through any downstream component, such as a gas conductance aperture of a mass spectrometer.

An axial DC field may be applied in each of the first ion guiding region 12, the second ion guiding region 14 and the third ion guiding region 16. The DC potential may drop between the first ion guiding region 12 and the second ion guiding region 14, as well as the second ion guiding region 14 and the third ion guiding region 16, as shown schematically in FIG. 1 (for illustrative purposes this is shown in respect of positive ions).

The strength of the axial DC field may increase between the first ion guiding region 12 and the second ion guiding region 14, and/or between the second ion guiding region 14 and the third ion guiding region 16. This can ensure efficient transit of ions from one region to next.

In various embodiments, the arrangement of ion guiding regions 12, 14 and 16 shown and described in relation to FIG. 1 may be situated in a collision cell region of a mass spectrometer, for example downstream of a quadrupole mass filter an upstream of a time of flight mass analyser.

Figure 2:
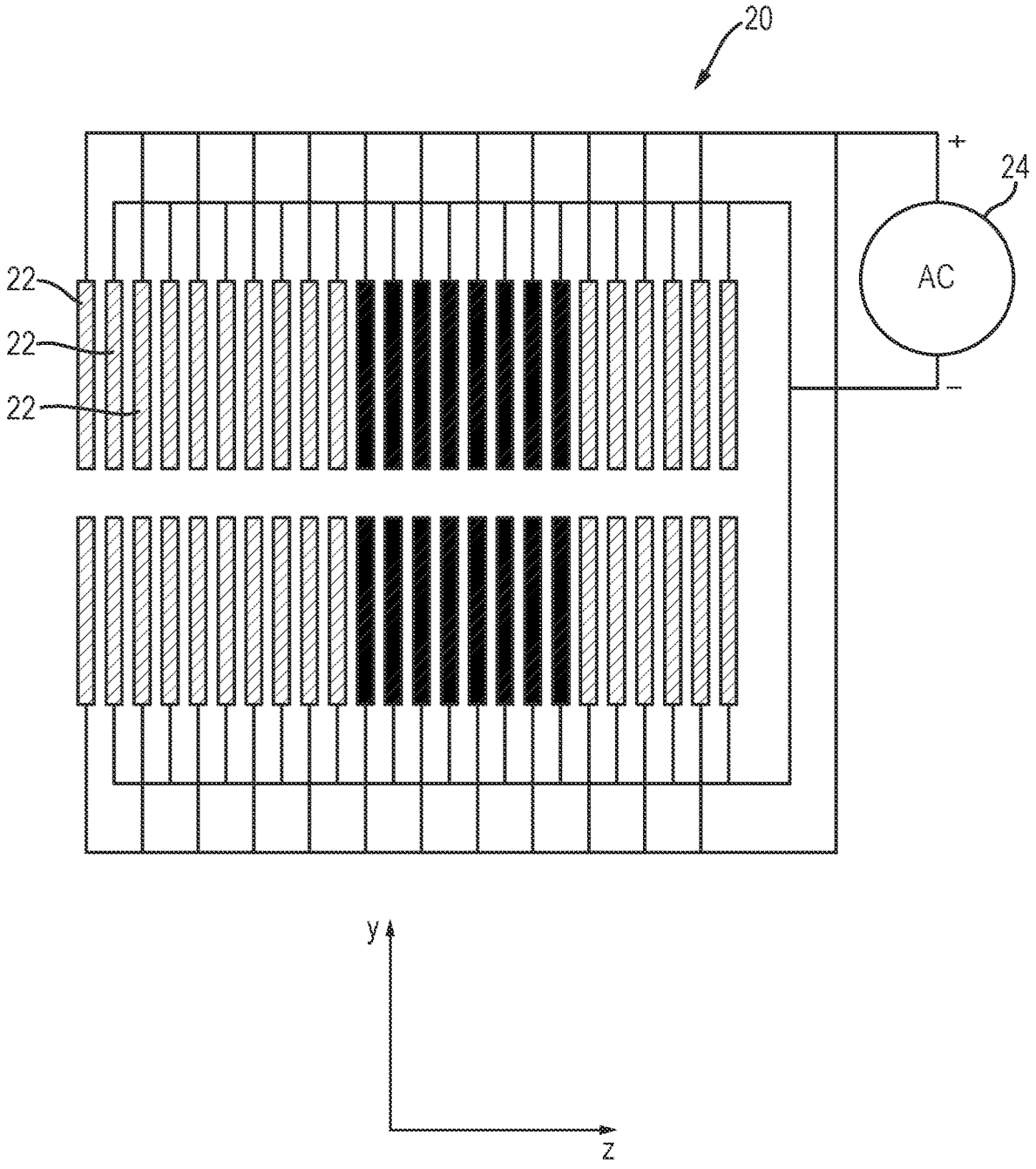
FIG. 2 shows schematically how the application of an AC or RF confining potential may be applied to electrodes of the ion guides described in the embodiment of FIG. 1.

FIG. 2 shows a schematic of the electrode arrangement that may be used in the arrangement shown and described in respect of FIG. 1, in the form of a longitudinal cross-section.

A stacked ring ion guide 20 may form any or all of the ion guiding regions 12, 14 and 16, and may comprise a plurality of electrodes 22, each having an aperture through which ions travel in use. A voltage supply 24 may apply an AC or RF voltage or potential to each of the electrodes 22 in the ion guide 20, wherein opposite phases of the AC or RF voltage may be applied to adjacent electrodes as shown schematically in FIG. 2. In addition, one or more transient DC voltages may be applied to the electrodes, for example to form a DC travelling wave, that may urge ions from one axial end of the guide to the other axial end.

Figure 3:
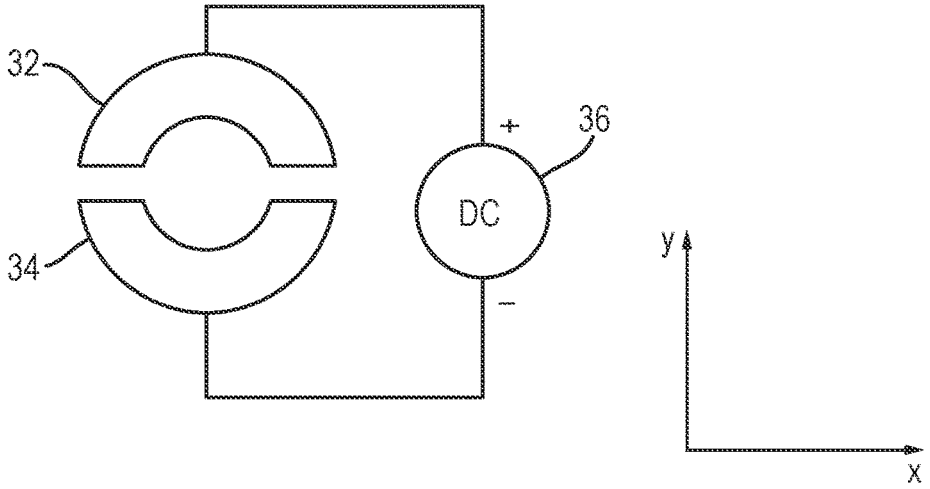
FIG. 3 shows schematically how the application of an orthogonal DC field may be applied to electrodes of the ion guides described in the embodiment of FIG. 1.

FIG. 3 shows an example of how the second ion guiding region 14 may be configured in order to allow an orthogonal DC field to be applied in this region, in the form of a schematic radial cross-section of the second ion guiding region 14.

Each ring electrode 30 may be segmented in the direction orthogonal to the direction of travel of ions. A DC voltage supply 36 may be provided. This allows an upper segment 32 of the ring electrode 30 to be connected to a positive terminal of the DC voltage supply 36, and a lower segment 34 of the ring electrode 30 to be connected to a negative terminal of the DC voltage supply 36. Thus, an orthogonal DC field may be applied between the upper and lower segments 32, 34, which can cause ions to be deflected from the central axis and towards the surfaces of the ring electrode 30 as described herein.

The same phase of an AC or RF voltage may be applied to the alternate axial electrodes, as shown and described in respect of FIG. 2, in order to confine the ions radially within the second ion guiding region 14.

Figure 4:
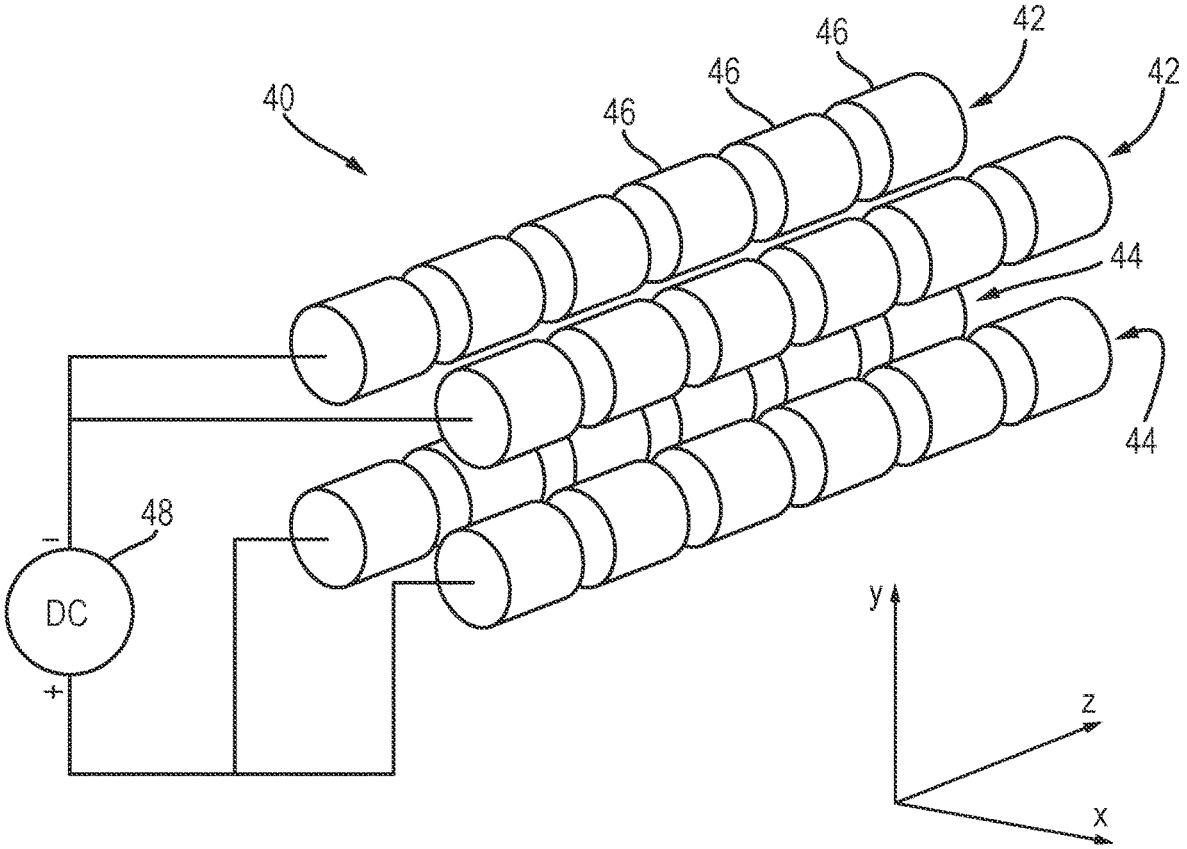
FIG. 4 shows a non-limiting embodiment of the present disclosure involving a segmented quadrupole ion guide.

FIG. 4 shows an embodiment of the present disclosure in which an apparatus comprises a segmented quadrupole ion guide 40. The quadrupole ion guide 40 comprises four rod electrodes 42, 44 and each of the rod electrodes 42, 44 may be divided into segments 46. This allows an electrostatic driving potential to be applied to the rod electrodes 42, 44 to urge ions from an entrance end of said ion guide to an exit end of said ion guide. For example, a travelling wave potential or other transient DC potential, a static DC potential (e.g., a voltage ramp) or a combination of these potentials may be applied to urge ions along the quadrupole ion guide 40.

An AC or RF voltage supply (not shown) may be provided in order to apply an AC or RF voltage to each of the segmented rods 42, 44, wherein the same phase of the AC or RF voltage may be applied to opposing pairs of rods, which can create a radial confining force.

A DC voltage supply 48 may be provided. This allows an upper pair of rod electrodes 42, including all of the segments 46 along the upper pair of rod electrodes 42, to be connected to a positive terminal of the DC voltage supply 48, and a lower pair of rod electrodes 44, including all of the segments 46 along the lower pair of rod electrodes 42, to be connected to a negative terminal of the DC voltage supply 48. Thus, an orthogonal DC field may be applied between the upper pair of rod electrodes 42 and the lower pair of rod electrodes 44, which can cause ions to be deflected from the central axis and towards the rod electrodes 42, 44. The orthogonal DC field may alternatively be applied as a dipole across a pair of opposing rods. In the embodiment of FIG. 4 there may be no axial component of force arising from the application of an RF confining field to the rods.

Various embodiments are contemplated in which other types of segmented multipole ion guides may be used. For example, the quadrupole may be replaced with a multipole ion guide such as a hexapole or octopole ion guide, all of which may have no axial component of an RF confining field.

In various embodiments the segmented quadrupole ion guide 40 shown and described in respect of FIG. 4 may be split into three ion guiding regions in a similar manner to the stacked ring ion guide shown and described in respect of claim 1. Each axial segment 46 of the rod electrodes may be analogous to one of the stacked ring electrodes in these embodiments.

In various embodiments the segmented quadrupole ion guide 40 shown and described in respect of FIG. 4 may be used as the central ion guiding region 14, with other ion guides (e.g., stacked ring ion guides) placed upstream and downstream of the segmented quadrupole ion guide to form the first ion guiding region 12 and the third ion guiding region 16 respectively.

In any of the aspects and embodiments described here in which a plurality of ion guiding regions are provided, for example the ion guiding regions 12, 14 and 16 described above, the apparatus and/or each ion guiding region may be configured such that the various AC or RF and/or DC voltages may be controllable separately, for example by a separate AC or RF and/or DC voltage supply for each ion guiding region.

In the case of a separately controllable DC voltage, for example, this can mean that the axial driving force in each ion guiding region (e.g., the ion guiding regions 12, 14 and 16 described above) may be independent controllable. For example, the velocity and/or amplitude of a DC travelling wave applied to each ion guiding region 12, 14 and 16 may be individually controllable, so as to obtain, for example, desired transmission and heating characteristics within each region and/or across the ion guide.

Figure 5:
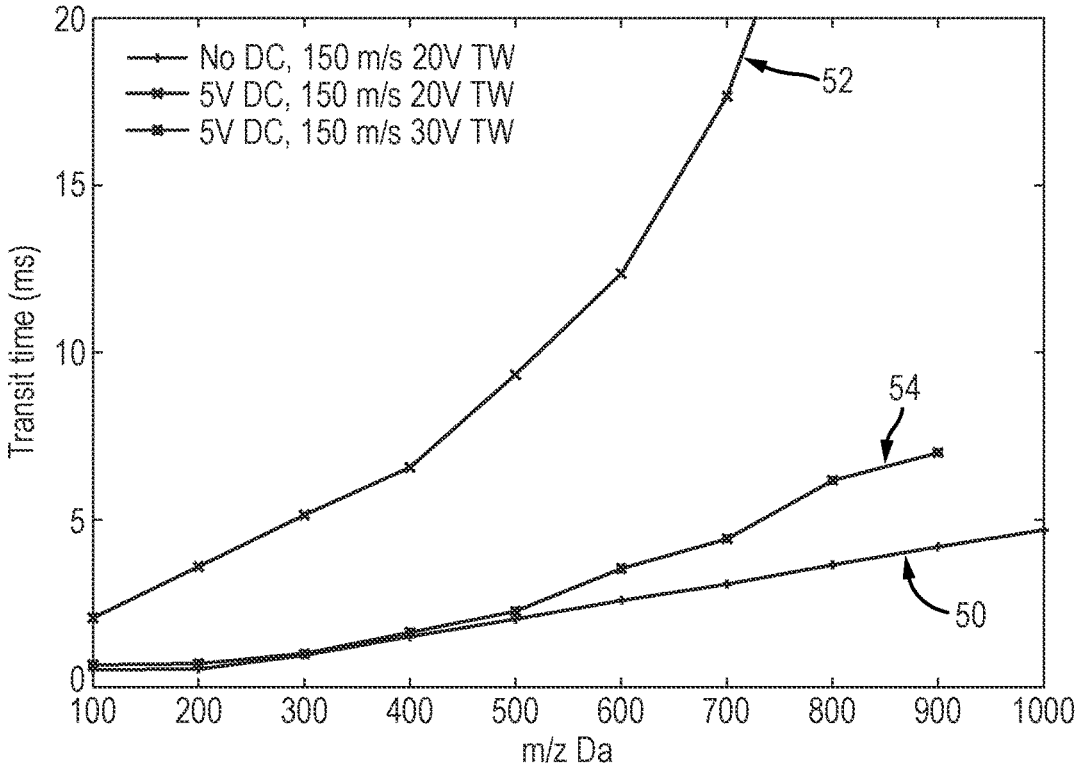
FIG. 5 is a graph showing the results of a computer-generated model of ion heating within an ion guide as described in relation to FIG. 1 across three different scenarios.

FIG. 5 shows the results of a computer generated ("SIMION") model of ion heating within the second ion guiding region 14 of an ion guide as described above, across three different scenarios. More specifically, FIG. 5 shows a plot of transit times, over a 70 mm distance, for a range of masses through an orthogonally segmented stacked ring ion guide, for example as shown in FIGS. 2 and 3.

The ion guiding region 14 in this model was maintained a pressure of 2.5 torr (333 Pa) of Nitrogen gas. A confining RF voltage was applied at 125 V (0-pk) and at a frequency of 2.5 MHz. The internal diameter of the ion guide was 5 mm, and each ring electrode was 0.5 mm thick with a plate to plate spacing of 1 mm. An electrostatic driving potential in the form of a DC travelling wave was applied, wherein each wave spanned two adjacent plates, with the waves separated by five plates.

A first plot 50 in FIG. 5 shows the transit time of ions over the 70 mm stacked ring ion guide, wherein the velocity of the travelling wave was set at 150 m/s and the amplitude of the travelling wave was set at 20 V. Transit times ranging from 0.5 ms to 4.7 ms were observed over the mass range, and these transit times typically reflect the differing collision cross sections and hence mobilities of ions of different mass to charge ratios included as part of this model.

A second plot 52 represents the same conditions as the first plot 50, but with a 5 V orthogonal DC field applied between the upper and lower electrode segments (see e.g., segments 32, 34 in FIG. 3). As discussed herein, this increases the temperature of the ions as they travel through the ion guiding region. As can be seen from FIG. 5, the transit time of ions through the second region 14 also increases.

It can be seen that the application of an orthogonal DC field, in some situations, may lead to a large increase in transit times. It has been found that the transit times of ions through the ion guiding region may be controlled by varying the characteristics of the AC or RF voltages applied to the ion guiding region (e.g., amplitude of the electrostatic driving potential).

For example, in the case of FIG. 5, and referring to the third plot 54, the amplitude of the DC travelling wave was increased to 30 V and it can be seen that this had the effect of reducing the time at which the ions will experience the increased temperature caused by the application of the orthogonal DC field. For example, a wider range of mass to charge ratios can be seen in the third plot 54 as compared to the second plot 52.

Therefore, in various embodiments the temperature of the ions can be controlled through the application (and variation) of an orthogonal DC field, and the time over which ions experience this temperature may be controlled through the variation of AC or RF voltages applied to the ion guiding region.

Figure 6:
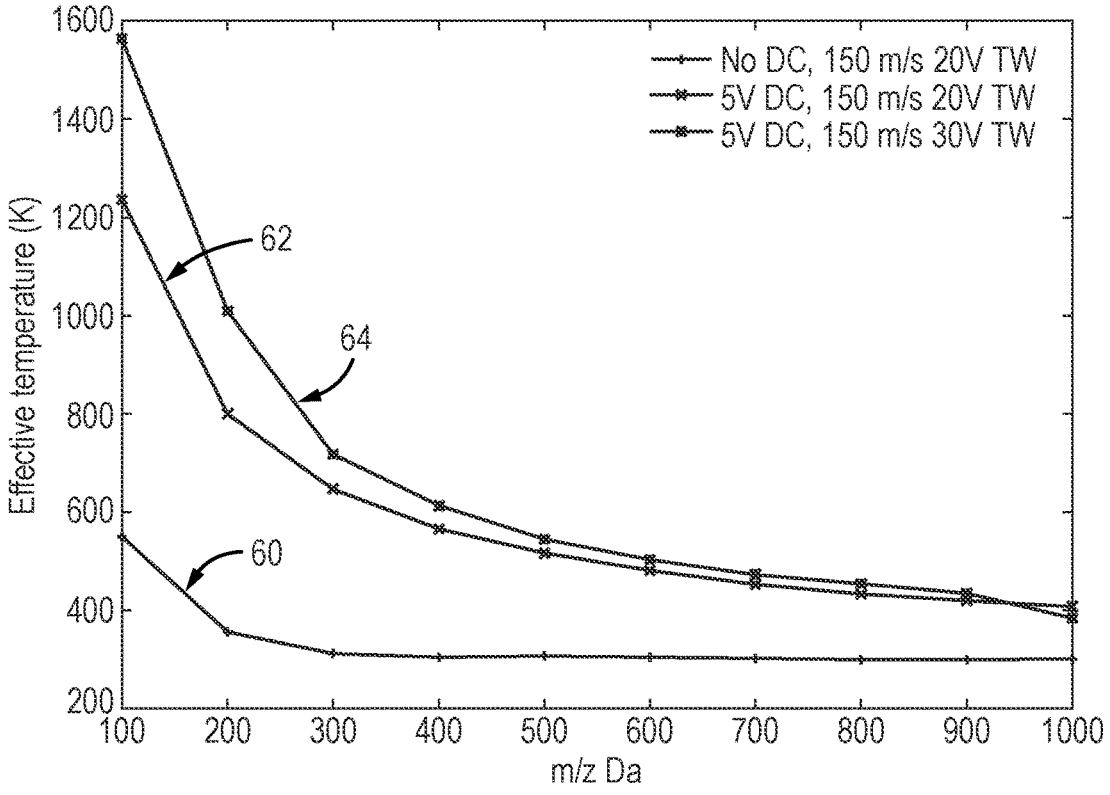
FIG. 6 is a graph showing the average temperature of ions across the different scenarios of FIG. 5 using the same computer-generated model.

FIG. 6 is a graph showing the average temperature of ions across the different scenarios of FIG. 5 using the same computer-generated model.

A first plot 60 corresponds to the first plot 50 of FIG. 5, in which no orthogonal DC field applied across the electrode segments. Ions in this case are close to room temperature, as expected for this type of ion guide which can have minimal RF components in an axial direction.

A second plot 62 corresponds to the second plot 52 of FIG. 5, in which a 5 V orthogonal DC field is applied between the upper and lower electrode segments. This increases the temperature of the ions travelling through the ion guiding region in a mass dependant manner, wherein ions having a lower mass to charge ratio experience higher temperatures than ions having a higher mass to charge ratio.

A third plot 64 corresponds to the third plot 54 of FIG. 5, in which the amplitude of the DC travelling wave was increased to 30 V, so as to decrease the transit time of ions through the ion guiding region. Whilst this also slightly increases the temperature of the ions travelling through the ion guiding region, the increase is not as significant as that achieved through application of the orthogonal DC field.

For a given arrangement (e.g., geometry and amplitude/frequency of RF confinement field), the average temperature experienced by ions within the ion guide may be controlled, as well as the duration over which ions will experience this temperature. This control may be achieved through application and variation of the electrostatic driving potential and the orthogonal DC field.

A segmented quadrupole ion guide was also modelled (e.g., the segmented quadrupole ion guide as shown and described in relation to FIG. 4, wherein the quadrupole rod set modelled had an inscribed radius of 2.5 mm and a length of 70 mm, with segments having a length of 2.75 mm and an inter segment spacing of 0.25 mm. The radial confinement field (RF) was applied with an amplitude of 500 V (0-pk) and with a frequency of 2 MHz (q=0.4 for mass 500).

A travelling wave DC voltage was applied to the segments of the quadrupole, at a velocity of 150 m/s and amplitude of 20 V. No orthogonal DC field was applied across the rods of the quadrupole. Ions having a mass to charge ratio of 500 were observed having a near thermal temperature and a drift time of 2.6 ms.

An orthogonal DC field was applied to the electrode segments of the quadrupole ion guide, with an amplitude or field strength of 10 V. The other conditions stated above were maintained at the same values. The temperature of the ions through the ion guide increased to about 500 K. Also, the transit or drift time of ions through the quadrupole was extended to 3.8 ms. The amplitude or strength of the orthogonal DC field was increased further to 15 V and this increased the temperature to about 900 K and the drift time to 5.5 ms.

Increasing the travelling wave pulse amplitude applied to the segments of the quadrupole had the effect of reducing the drift or transit time. The amplitude of the travelling wave could be adjusted such that the drift or transit time of ions through the quadrupole, when heated due to the orthogonal DC field, was substantially the same as when no orthogonal DC field were applied (with the temperature substantially unaffected).

Therefore, similar effects to those discussed above in respect of the orthogonally segmented stacked ring ion guide were achieved in a segmented quadrupole ion guide. That is, the transit time of ions through the quadrupole ion guide increased as heating increased upon application of the orthogonal DC field.

It has been found that the temperature rise of ions due to the orthogonal DC potential, relative to the transit time, may be larger in the segmented quadrupole as compared to a stacked ring ion guide. Consequently, a segmented quadrupole (or other multipole) may be used if the transit time of the ions through the ion guide needs to be as short as possible.

It is envisaged that other ion guides may be used whilst still falling within the broadest scope of the present disclosure. For example, the ion guide could be a sandwich plate type device comprising a series of opposed AC or RF plate electrodes, which may run along the length of the sandwich plate ion guide, as well as a series of upper and lower DC plate electrodes. An electrostatic driving potential may be applied to the upper and lower DC plate electrodes, while an orthogonal DC field may be applied across the upper and lower plate electrodes. A radially confining AC or RF field may be applied to the AC or RF plate electrodes, for example to radially confine ions in a first direction, wherein DC confinement may be achieved in a second, different direction.

The ion guide may be an annular or curved ion guide, wherein the ion guide may be curved along at least a portion thereof. Alternatively, the ion guide may be a co-axial (or straight) ion guide as shown and described in respect of FIGS. 1-4. The ion guides shown in FIGS. 1-4 may instead be curved or annular, and the same principles as described above in respect of ion heating and transit time would apply.

According to various embodiments an ion mobility spectrometer or separator may be provided and comprise an ion guide according to any of the aspects or embodiments described above and herein. Ions may be continuously fed or pulsed into the ion mobility spectrometer or separator and be separated according to their ion mobility in the ion guide, such that an orthogonal DC field may be applied to the ion mobility separation region.

Various embodiments are envisaged in which ions are transferred into the ion mobility spectrometer or separator, for example a plurality of groups of ions may be pulsed into the ion mobility spectrometer or separator, and the heating applied to different ions (e.g., different groups of ions) may be varied (e.g., by varying the characteristics of the electrostatic driving potential and/or orthogonal DC field) so that the average temperature experienced by selected ions (e.g., ions in a particular group of ions) within the ion guide may be controlled, as well as the duration over which those ions will experience this temperature. The selected ions may have a particular retention time or mass to charge ratio.

In such a situation, an orthogonal DC field may be applied during the time which a first group of ions are transported through the ion guide and separated according to their ion mobility. An orthogonal DC field may not be applied, or may be applied at a different amplitude or strength, during the time which a second, different group of ions are transported through the ion guide and separated according to their ion mobility. Thus, ions of a certain mobility or range of mobilities may be selectively heated.

In any of the aspects or embodiments described herein, it has been recognised that the temperature of an ion that is subject to a given orthogonal DC field (e.g., having a given amplitude) can depend on the mass to charge ratio of the ion. In order to evenly heat ions having a different mass to charge ratio, for example, a device may be located upstream of the ion guide, wherein the device may be arranged and configured to separate ions according to mass to charge ratio.

Alternatively, or additionally, groups of ions may be introduced, for example pulsed or continuously fed into the ion guide and the parameters of the ion guide (e.g., electrostatic driving potential and/or orthogonal DC field) may be controlled so as to vary the heating applied to ions in different mass to charge ratio ranges. The device may comprise an analytical ion trap, mass filter or ion mobility spectrometer or separator.

In any of the aspects or embodiments described herein, it is envisaged that the orthogonal DC field may be applied using means other than the electrodes forming the ion guide, for example through the use of auxiliary electrodes or resistive rods or coatings.

For example, a conventional stacked ring ion guide may be provided that includes an AC or RF voltage supply for applying an AC or RF voltage to adjacent ring electrodes, and a DC voltage supply for applying an electrostatic driving potential in the form of, for example, a travelling wave potential or other transient DC potential, or a static DC potential (e.g., a voltage ramp) or a combination of these potentials. A pair of auxiliary electrodes may be located on opposing sides of the ion guide, and a DC voltage may be applied to the electrodes to form the orthogonal DC field along at least a portion of the ion guide.

Similar auxiliary electrodes could be placed on opposing sides of a segmented quadrupole (or multipole) ion guide as well, in order to create the orthogonal DC field along at least a portion of its length, instead of applying the orthogonal DC field using the rods.

Without wishing to be bound by theory, it is thought that the increase in residence time when an orthogonal DC field is applied across the device, for the same electrostatic driving potential, may be attributed to the increase in radial velocity caused by the ions being forced into closer proximity to the RF confining electrodes. This is thought to result in a higher probability of collisions, for example with a buffer gas and hence the axial velocity of the ions may be reduced due to increased collisional damping. This may be similar to increasing the pressure of the buffer gas.

In embodiments involving a stacked ring ion guide, as ions are forced further from the central axis of the device ions can experience an additional axial motion due to the confining RF potential between adjacent rings, but in this case it is thought that the radial velocity increase is the dominant cause of the increase in ion temperature.

In embodiments involving a segmented multipole there may be no axial force applied to ions due to either the confining RF potential or the orthogonal DC field. Therefore substantially all of the heating effect may arise from the increase in radial velocity caused by proximity to the RF confining electrodes.

In certain applications, the technology disclosed herein can provide a way of selectively removing weakly and/or covalently bound adducts from ions. This can provide higher quality mass spectral data. This can be particularly useful for high molecular weight bio-molecules, such as proteins and protein complexes.

The heating described herein (using an orthogonal DC field) may be performed in any region of the mass spectrometer, and the methods disclosed do not rely on particular gas flows or ion trapping.

As discussed above it may be simple to switch the ion guide between a first mode in which ions are not heated through application of the orthogonal DC field, and a second mode in which ions are heated through application of the orthogonal DC field. As such, the ion guide may be used as (or switched to) a standard ion guide (in an "ion guiding mode"), as a standard collision or reaction cell, or within or as a standard ion mobility spectrometer or separator with no additional ion heating simply by switching the orthogonal DC field strength to zero.

The various aspects and embodiments disclosed can lead to improved control of the ion temperature and duration of ion heating, including in some examples high transmission of a continuous ion beam.

Although the present invention has been described with reference to preferred embodiments, it will be understood by those skilled in the art that various changes in form and detail may be made without departing from the scope of the invention as set forth in the accompanying claims.

The invention claimed is:

1. A method of guiding ions, comprising:

providing an ion guide comprising a plurality of electrodes;

confining ions radially within said ion guide by applying one or more RF voltages to said plurality of electrodes;

applying an orthogonal DC field along at least a portion of said ion guide such that the average path taken by ions through the ion guide is displaced in a radial direction towards the electrodes so as to cause heating of the ions due to the RF voltages as the ions travel through said ion guide;

varying an electrostatic driving potential applied to said plurality of electrodes to urge ions along the axial length of the ion guide so as to vary an amount of heating experienced by ions based on their mass, m/z ratio, ion mobility or retention time due to the RF voltages as the ions travel through the ion guide.

2. A method as claimed in claim 1, wherein said electrostatic driving potential is applied in the form of a DC travelling wave potential or other transient DC potential.

3. A method as claimed in claim 1, further comprising transmitting ions through said ion guide, and selectively applying said orthogonal DC field in order to increase or decrease the temperature of selected ions as they travel through said ion guide.

4. A method as claimed in claim 1, further comprising transmitting ions through said ion guide, and varying the amplitude of said orthogonal DC field applied to different ions as they travel through said ion guide.

5. A method as claimed in claim 1, further comprising:

(i) varying the amplitude of said orthogonal DC field to achieve a desired temperature for selected ions as they travel through said ion guide; and (ii) varying the properties of the electrostatic driving potential to achieve a desired transit time for selected ions through said ion guide.

6. A method as claimed in claim 1, wherein said ion guide comprises a first ion guiding region, a second ion guiding region downstream of said first ion guiding region, and a third ion guiding region downstream of said second ion guiding region, and said method further comprises:

applying said orthogonal DC field in only said second ion guiding region so as to deflect ions travelling through the second ion guiding region in an orthogonal direction.

7. A method as claimed in claim 1, further comprising transmitting a plurality of groups of ions through said ion guide, each having a different range of ion mobilities, and selectively applying said orthogonal DC field in order to increase or decrease the temperature of selected groups of ions as they travel through said ion guide.

8. A method as claimed in claim 1, further comprising transmitting a plurality of groups of ions through said ion guide, each having a different range of mass to charge ratios, and selectively applying said orthogonal DC field in order to increase or decrease the temperature of selected groups of ions as they travel through said ion guide.

9. A method as claimed in claim 1, wherein said ion guide comprises a plurality of electrodes, each having an aperture through which ions travel in use.

10. A method as claimed in claim 1, wherein said ion guide comprises a segmented multipole ion guide.

11. A method as claimed in claim 1, further comprising supplying a buffer gas to said ion guide.

12. A method as claimed in claim 1, wherein said ion guide forms part of a collision, fragmentation or reaction cell.

13. A method as claimed in claim 6, wherein no orthogonal DC field is applied to the first and third sections.

14. An apparatus comprising:

an ion guide comprising a plurality of electrodes, and a control system, wherein the control system is arranged and adapted to:

apply one or more RF voltages to said plurality of electrodes to confine ions radially within said ion guide in use;

apply an orthogonal DC field along at least a portion of said ion guide such that the average path taken by ions through the ion guide is displaced in a radial direction towards the electrodes so as to cause heating of the ions due to the RF voltages as the ions travel through said ion guide in use; and vary an electrostatic driving potential applied to said plurality of electrodes to urge ions along the axial length of the ion guide so as to vary an amount of heating experienced by ions based on their mass, m/z ratio, ion mobility or retention time due to the RF voltages as the ions travel through the ion guide.

* * * * *